US005249382A

United States Patent [19]

Moynihan

[11] Patent Number: 5,249,382

[45] Date of Patent: Oct. 5, 1993

[54] PATTERNED INDICIA FORMING SYSTEM AND METHOD

[76] Inventor: Patrick B. Moynihan, 1205 Halls Chance La., Belcamp, Md. 21017

[21] Appl. No.: 736,611

[22] Filed: Jul. 26, 1991

[51] Int. Cl.[5] ..... G09F 3/04

[52] U.S. Cl. ..... 40/630; 156/344; 428/41; 434/160

[58] Field of Search ..... 40/630, 638, 450, 594, 40/595; 428/41, 42; 156/344, 249, 234, 240, 63; 434/159, 160

[56] References Cited

U.S. PATENT DOCUMENTS 3,741,786 5/1971 Torrey ..... 156/344
4,059,912 11/1977 Noah ..... 40/630
4,550,683 11/1985 Jones ..... 428/42

*Primary Examiner*—Kenneth J. Dorner
*Assistant Examiner*—C. Hope Davis
*Attorney, Agent, or Firm*—Morton J. Rosenberg; David I. Klein

[57] ABSTRACT

A patterned indicia forming system (10) is provided which includes the combination of a flexible carrier layer (18) and a flexible backing layer (28). A plurality of sets of indicia elements (20) are sandwiched between the carrier layer (18) and the backing layer (28). Each set (20) of indicia elements is formed of individual indicia elements (22) which may be removed from a selective set (20) to form a patterned indicia element (16) which may be mounted on a base surface (14). Through use of the patterned indicia forming system (10), a user may inexpensively and simply provide an aesthetically pleasing and professional looking set of sign indicia (16) mounted on a base surface (14).

10 Claims, 1 Drawing Sheet

PATTERNED INDICIA FORMING SYSTEM AND METHOD

BACKGROUND OF THE INVENTION

1. Field of the Invention

This invention directs itself to a system and method for forming patterned indicia on a base surface. In particular, this invention is directed to a method and system for creating aesthetically pleasing signs formed of alphabetic letters and/or integers. More in particular, this invention relates to a patterned indicia forming system which creates professional looking signs in a simple and easy manner utilizable by a user having a minimum of technical ability. Still further, this invention directs itself to a patterned indicia forming system and method which allows a user to prepare and mount an aesthetically pleasing sign on a base surface in a minimum amount of time at a low costing level. Further, this invention directs itself to a patterned indicia forming system which may be packaged in roll form and dispensed therefrom in a simple manner. Additionally, this invention relates to a patterned indicia forming system which allows the user to create centered indicia having a plurality of lines in a simple, inexpensive manner. Still further, this invention directs itself to a patterned indicia forming system which includes a plurality of sets of indicia elements sandwiched between a flexible carrier layer and a backing layer. Further, this invention directs itself to a patterned indicia forming system where individual indicia elements may easily be removed from a flexible carrier layer and then mounted and adhered to a base surface in a minimum amount of time.

2. Prior Art

Prior systems and methods for forming sign indicia on base surfaces is known in the art. The best prior art known to Applicant includes U.S. Pat. Nos. 4,948,450, 4,572,855; 4,849,043; 4,858,357; 2,963,220; 4,895,747; 4,777,747; 4,747,619; 4,977,006; 4,967,740; 4,479,316; and, 4,744,591.

In some prior art systems such as that shown in U.S. Pat. No. 4,948,450, there are provided adhesive labels which may be attached and removed from base surfaces. However, such prior art systems do not provide for the particular method and system of the subject inventive concept, in that such does not allow for preparation of individual sign indicia, patterned in the manner herein provided.

Other prior art systems, such as that shown in U.S. Pat. No. 4,572,855 provide for label tape. However, such prior art systems do not provide for the particular indicia elements of the subject invention concept which permits character references to be marked or otherwise aesthetically enhanced.

Other prior art systems, such as that shown in U.S. Pat. No. 4,849,043, are directed to processes and systems for producing labels on a continuous roll. In such prior art systems, a reel carries a succession of self-adhesive labels. Although this provides for a roll type dispensing method and system, it does not provide for the patterned indicia forming concept as herein envisaged.

In other prior art systems, sign indicia are formed by professional technique, such as stencilling or otherwise hand forming the particular indicia on a base surface. Such prior art systems and methods are extremely time consuming and expensive for even the creation of simple patterned indicia.

SUMMARY OF THE INVENTION

A patterned indicia forming system is provided which includes a flexible carrier layer. A mechanism for forming indicia is included having a plurality of sets of indicia elements, with each of the indicia elements having a frontal surface releasably secured to the flexible carrier layer. Additionally, the overall system includes a flexible backing layer releasably secured to a rear surface of each of the indicia elements. The flexible backing layer is removable from the rear surface of the indicia elements for attachment of the indicia elements to a base surface.

DESCRIPTION OF THE PREFERRED EMBODIMENTS

Figures 1, 2, 3, 4:
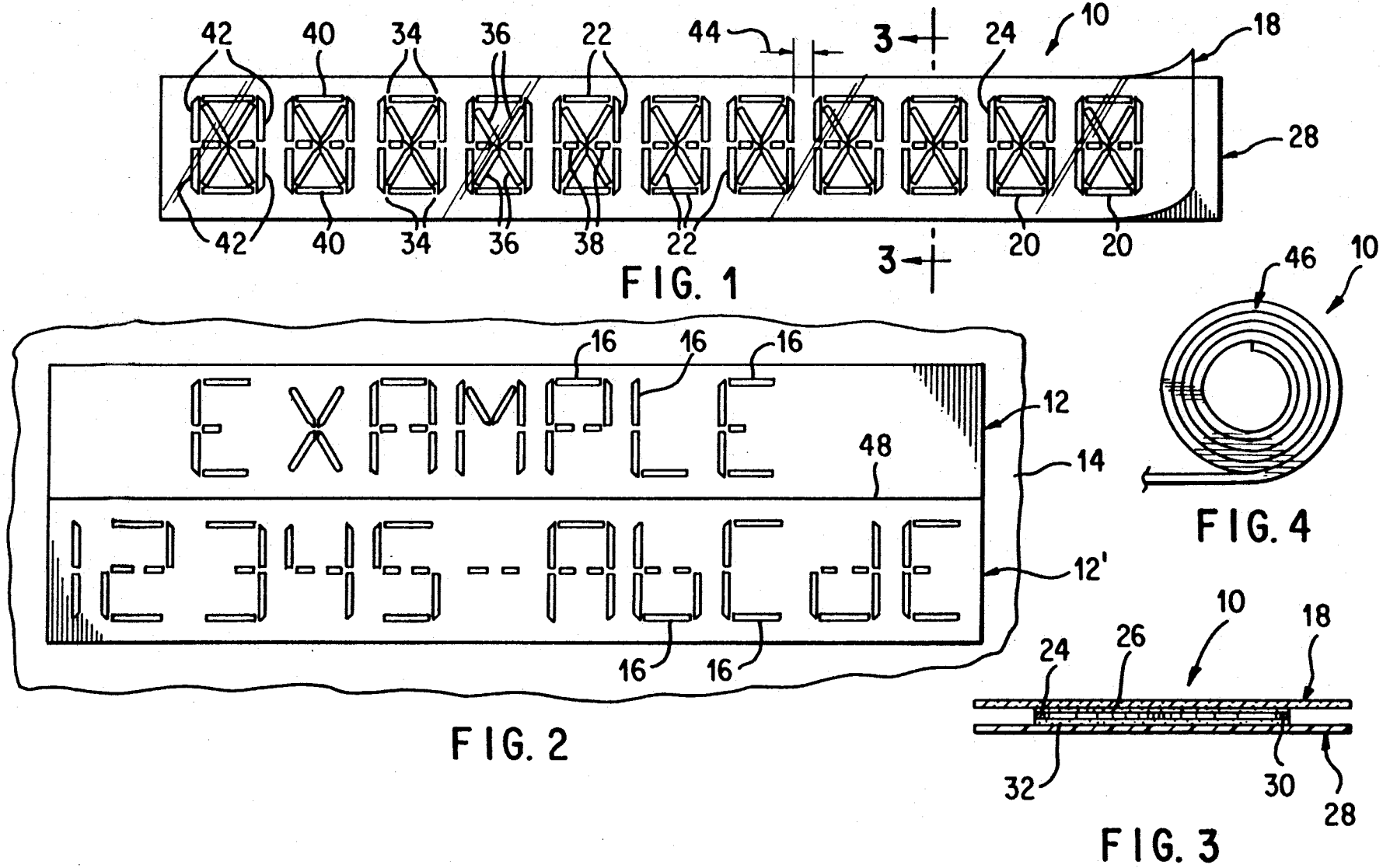
FIG. 1 is a plan view of the subject patterned indicia forming system.
FIG. 2 is a plan view of the subject patterned indicia forming system showing patterned indicia elements mounted to a base surface.
FIG. 3 is a cross-sectional view of the patterned indicia forming system taken along the Section Line 3—3 of FIG. 1; and, FIG. 4 is an elevational view of the patterned indicia forming system stored in a roll form.

Referring now to FIGS. 1–4, there is shown patterned indicia forming system 10 for fixedly securing signs 12, 12' to base surface 14, as is shown in FIG. 2. The overall concept of patterned indicia forming system 10 is to allow a user to easily create signs 12, 12' which may be adhesively attached to any base surface 14 in a manner that the finally applied sign 12, 12' is professional in aesthetic appeal and inherently provides sign indicia 16 to be aligned with each of the other sign indicia and further inherently providing even spacing or displacement between the various sign indicia 16, as is shown in FIG. 2. In the manner to be detailed in following paragraphs, the user has the ability to simply create sign indicia 16 associated with all of the alphabetic letters and integers, as well as creating other pattern contours. Additionally, the user has the ability to create any number of sign indicia 16 patterns and only uses the necessary amount in the creation of sign 12 or 12'. As can be seen, and as will be further described, sign elements 12 and 12' may easily be centered with respect to sign indicia 16 on sign 12 when taken in context with sign indicia 16 on sign element 12'.

Patterned indicia forming system 10 includes flexible carrier layer 18, as is clearly seen in FIGS. 1 and 3. Flexible carrier layer 18 may be formed of a plastic composition which is translucent, or substantially transparent. Such transparent plastic layers are well-known in the art and is usable as a carrier for indicia element sets 20 wherein each set is formed of indicia elements 22, as is shown in FIG. 1. Each of indicia elements 22 includes frontal surface 24 which is releasably secured to flexible carrier layer 18 by some very low force adhesive 26 wherein flexible carrier layer 18 may be removed from indicia elements 22 by peeling away flexible carrier layer 18 subsequent to sign indicia 16 being attached to base surface 14, as will be described in following paragraphs. The particular composition of frontal surface adhesive 26 is not important to the inventive concept as herein described, with the exception that such adhesive allow removal of flexible carrier layer 18 subsequent to sign indicia 16 being fixedly mounted or secured to base surface 14.

Patterned indicia forming system 10 further includes flexible backing layer 28 as shown in FIGS. 1 and 3, secured to rear surface 30 of indicia element sets 20. Flexible backing layer 28 is removably secured to indicia rear surfaces 30 through adhesive coating 32 which allows flexible backing layer 28 to be removed from indicia element sets 20 at the discretion and upon use by the operator. The particular composition of adhesive coating 32 is not important to the inventive concept as herein described and may be one of a number of commercially available adhesives with the only requirement being that adhesive coating 32 has a sufficiently low adhesive force to allow removal of flexible backing layer 28 from indicia element sets 20 upon application of the patterned indicia forming system 10 and method as herein described.

Patterned indicia forming system 10 includes indicia element sets 20 wherein each set 20 includes a plurality of indicia elements 22 forming a rectangularly contoured envelope, as is seen in FIG. 1. The rectangularly contoured envelope formed by the attached indicia elements 22 may provide for what is commonly termed an LED set of elements. Each of indicia elements 22 are individual in nature and may be removed from a particular indicia element set 20 to create various patterns, such as alphabet letters, as shown in FIG. 2 for sign indicia 16.

Each indicia element set 20 is formed of a plurality of indicia elements 22 and includes a pair of upper and lower horizontally directed indicia elements 40, as well as two pairs of opposing vertically directed indicia elements 42. The overall rectangular envelope of indicia element set 20 includes the indicia set vertices 34 having extending therefrom diagonal indicia elements 36 with horizontal indicia elements 38 intersecting at a diagonal crossover point, as is seen in FIG. 1. It is to be remembered that each of indicia elements 22, whether they be the horizontally directed, vertically directed, or diagonally directed indicia elements, that each of the individual indicia elements 22 may be removed to provide sign indicia 16, as shown in FIG. 2.

As can be seen in FIG. 1, each of indicia element sets 20 are spaced from each other in the horizontal direction by a dimension 44 which is substantially equal between each element set 20. In this manner, an aesthetically pleasing sign indicia 16 may be created with all of the letters and/or numbers having an equal spacing in the horizontal direction. Additionally, each of indicia element sets 20 are generally vertically aligned each with respect to the other in order to provide a final sign indicia 16 which has a substantially uniform base line when attached or secured to base surface 14.

In this manner, there is provided a plurality of sets 20 of indicia elements 22 which are sandwiched between flexible carrier layer 18 and flexible backing layer 28 for subsequent use. The overall combination of flexible carrier layer 18, indicia element sets 20, and flexible backing layer 28 may be in the order of twice or three times the thickness of commonly used adhesive tape, such as Scotch Tape, or like adhesive tapes.

Indicia elements 22 may be formed of vinyl or like composition, not important to the inventive concept as herein described, with the exception that it be of a composition which can be adhered to both the flexible carrier layer 18 and the backing layer 28 prior to use. Additionally, differing colors of indicia elements 22 may be provided for further aesthetically pleasing sign elements 16, or in the alternative, may be formed of a composition which provides for a white color which would allow the user to color in the particular sign indicia 16 at his or her discretion.

Patterned indicia forming system 10, due to the flexible nature of backing layer 28, carrier layer 18 and individual indicia elements 22, allows for system 10 to be rolled into roll 46 as shown in FIG. 4. In this manner, the combination strips or layers may be rolled prior to use and dispensed from a standard commercially available type dispenser, well known in the art.

In use, the operator initially determines the type of sign and the number of characters needed to be applied to base surface 14. The number of sets 20 may be unrolled from roll 46 and cut by use of scissors or other cutting means. Flexible backing layer 28 is removed from flexible carrier layer 18 and indicia sets 20 by peeling away flexible backing layer 28. Individual indicia elements 22 are then removed from flexible carrier layer or strip 18 by use of tweezers, or other like implements, to provide particular sign indicia 16 as shown in FIG. 2. Once the particular sign indicia 16 has been formed by removal of individual indicia elements 22, flexible carrier layer 18 and sign indicia 16 are applied to base surface 14. Carrier layer 18 is pressed manually against base surface 14 and the user may cause a rubbing action to a frontal surface of carrier layer 18. Carrier layer 18 may then be peeled from base surface 14 to provide sign indicia 16 adhesively secured to base surface 14. Obviously, where flexible carrier layer 18 is translucent or transparent, such does not have to be removed from base surface 14 and such removal is at the discretion of the operator.

Where a particular sign such as that provided by the sign elements 12, 12' is needed to be in two or more lines, a second set of indicia elements 20 may be pulled from roll 46 and formed in the same manner as previously described. Placement of the second line is simply and easily accomplished by interfacing sign element 12' with upper sign element 12 along interfacing boundary 48 as shown in FIG. 2. Additionally, centering of sign indicia 16 of sign element 12' can easily be accomplished with respect to sign element 12 by simply manually displacing sign element 12' until sign indicia 16 of sign element 12' are centered with respect to sign indicia 16 of sign element 12.

In this manner, there is provided a time saving, labor saving, simple technique for producing an aesthetically pleasing and professionally looking set of patterned indicia mounted on base surface 14.

It is to be understood that patterned indicia forming system 10 may be used for providing horizontal numbering or lettering positioning signs, or indicia sets 20 may be formed in an orthogonal manner, as shown in FIG. 1, to allow a vertically directed set of lettering or numbers. Additionally, message or number sequences may be formed in mirror image order in order that sign indicia 16 be mounted on the rear surface of a window or some like surface. In order to accomplish a reverse order or mirror image set of sign indicia 16, the user may visually note sets 20 through flexible carrier layer 18. A line or other type of indication may be formed on flexible carrier layer 18 in the area of particular indicia elements 22 to be removed. Adhesive backing layer 28 is then removed from the combination of sets 20 and flexible carrier layer 18 and individual elements 22 which have been marked on carrier tape 18 are removed from overall sets 20 in the manner previously described, as by tweezers or some like technique. Once the desired particular elements 22 are removed, carrier tape 18 containing sign indicia 16 is then pressed against base surface 14 to provide a properly patterned sign indicia 16 when viewed on an opposing side of base surface 14.

Patterned indicia forming system 10 provides a simple and effective method of forming patterned indicia 16 mounted on base surface 14 and includes the steps of providing for a plurality of sets of indicia elements 20 which are sandwiched in releasable securement between flexible carrier layer 18 and flexible backing layer 28, as previously discussed. Flexible backing layer 28 is removed from a predetermined number of sets 20 of indicia elements and a predetermined number of indicia elements 22 are removed from selective sets 20 in order to form some predetermined pattern of indicia elements, as shown for sign indicia 16. In this manner, sign indicia 16 are secured to front carrier layer 18.

Carrier layer 18 and sign indicia 16 then adhere to base surface 14 and the user, at his or her discretion, may remove carrier layer 18 from base surface 14 leaving sign indicia 16 mounted thereto.

The step of providing the plurality of sets of indicia elements 20 includes the step of establishing the flexible backing layer 28 in overlying and coincident relation with respect to flexible carrier layer 18. In this manner, the combined flexible backing layer 28, carrier layer 18, and indicia sets 20 may be mounted in a roll 46 as shown in FIG. 4 for ease of dispensing a predetermined number of indicia element sets at the discretion and need of the user.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A patterned indicia forming system, comprising:

(a) a flexible carrier layer;

(b) means for forming indicia having a plurality of sets of indicia elements, each of said indicia elements defining a linearly directed line element having a frontal surface releasably secured to said flexible carrier layer; and, (c) a flexible backing layer releasably secured to a rear surface of each of said indicia elements, said flexible backing layer being removable from said rear surface of said indicia elements for attachment of said indicia elements to a base surface, each of said sets of said indicia elements defining a plurality of separable indicia elements forming a substantially rectangularly contoured envelope, being formed by at least four of said indicia elements, said indicia elements being individually removable from said flexible carrier layer, each of said sets of indicia elements being linearly aligned with a next adjacent set of indicia elements for linearly aligning said patterned indicia on said base surface, said rear surface of said indicia elements includes an adhesive coating for attachment to said base surface, each of said sets of said indicia elements including a further set of diagonally positioned indicia elements mounted to said flexible carrier layer within said rectangularly contoured envelope.

2. The patterned indicia forming system as recited in claim 1 including at least a pair of horizontally directed indicia elements extending adjacent an intersection area of said diagonally positioned indicia elements.

3. The patterned indicia forming system as recited in claim 1 where said sets of said indicia elements are spaced each from the other by substantially equal distances.

4. The patterned indicia forming system as recited in claim 1 where a combination of said flexible carrier layer, said sets of said indicia elements and said flexible backing layer is rolled to provide said pattern indicia forming system in a roll.

5. The patterned indicia forming system as recited in claim 1 where said flexible carrier layer is formed of a plastic composition.

6. The patterned indicia forming system as recited in claim 1 where said flexible carrier layer is substantially transparent.

7. The patterned indicia forming system as recited in claim 1 where said flexible carrier layer is substantially translucent.

8. The patterned indicia forming system as recited in claim 1 where each of said indicia elements is removable from said set of indicia elements to provide a predetermined pattern of said indicia elements.

9. The patterned indicia forming system as recited in claim 1 where said flexible carrier layer is removed from said frontal surfaces of said indicia surfaces subsequent to a set of patterned indicia elements being adhered to said base surface.

10. The patterned indicia forming system as recited in claim 1 where said flexible backing layer is formed of wax paper.

* * * * *